US006075461A

United States Patent [19]

Smith

[11] Patent Number: 6,075,461

[45] Date of Patent: Jun. 13, 2000

[54] DISPOSABLE ELECTROMAGNETIC SIGNAL REPEATER

[75] Inventor: Harrison C. Smith, Anna, Tex.

[73] Assignee: Halliburton Energy Services, Inc., Dallas, Tex.

[21] Appl. No.: 09/238,401

[22] Filed: Jan. 27, 1999

Related U.S. Application Data

[62] Division of application No. 08/999,088, Dec. 29, 1997.

[51] Int. Cl.[7] ..... G01V 3/00

[52] U.S. Cl. ..... 340/853.7; 340/854.11; 340/870.31; 367/82

[58] Field of Search ..... 340/853.7, 853.3, 340/854.4, 854.6, 820.31; 324/338; 367/82

[56] References Cited

U.S. PATENT DOCUMENTS

| | | | |
|---|---|---|---|
| 2,379,800 | 7/1945 | Hare | 175/356 |
| 2,411,696 | 11/1946 | Silverman et al. | 177/352 |
| 3,186,222 | 6/1965 | Martin | 73/151 |
| 3,333,239 | 7/1967 | Silverman | 340/18 |
| 4,019,148 | 4/1977 | Shawhan | 328/167 |
| 4,087,781 | 5/1978 | Grossi et al. | 340/18 |
| 4,160,970 | 7/1979 | Nicolson | 340/18 |
| 4,181,014 | 1/1980 | Zuvela et al. | 73/151 |
| 4,215,426 | 7/1980 | Klatt | 367/83 |
| 4,293,936 | 10/1981 | Cox et al. | 367/82 |
| 4,293,937 | 10/1981 | Sharp et al. | 367/82 |
| 4,298,970 | 11/1981 | Shawhan et al. | 367/82 |
| 4,302,757 | 11/1981 | Still | 340/854 |
| 4,348,672 | 9/1982 | Givier | 340/854 |
| 4,363,137 | 12/1982 | Salisbury | 455/40 |
| 4,387,372 | 6/1983 | Smith et al. | 340/854 |
| 4,406,919 | 9/1983 | Pospischil | 178/69 |
| 4,468,665 | 8/1984 | Thawley et al. | 340/856 |
| 4,496,174 | 1/1985 | McDonald et al. | 285/53 |
| 4,525,715 | 6/1985 | Smith | 340/854 |
| 4,562,559 | 12/1985 | Sharp et al. | 367/82 |
| 4,578,675 | 3/1986 | MacLeod | 340/855 |
| 4,616,702 | 10/1986 | Hanson et al. | 166/65.1 |
| 4,684,946 | 8/1987 | Issenmann | 340/855 |
| 4,691,203 | 9/1987 | Rubin et al. | 340/856 |
| 4,725,837 | 2/1988 | Rubin | 340/855 |
| 4,739,325 | 4/1988 | MacLeod | 340/854 |
| 4,757,157 | 7/1988 | Pelet | 174/50 |
| 4,766,442 | 8/1988 | Issenmann | 343/719 |
| 4,788,544 | 11/1988 | Howard | 340/853 |
| 4,800,570 | 1/1989 | Perrotta et al. | 375/4 |
| 4,839,644 | 6/1989 | Safinya et al. | 340/854 |
| 4,845,493 | 7/1989 | Howard | 340/853 |
| 4,901,069 | 2/1990 | Veneruso | 340/853 |
| 4,908,804 | 3/1990 | Rorden | 367/81 |

(List continued on next page.)

FOREIGN PATENT DOCUMENTS

| | | | |
|---|---|---|---|
| 0 672 819 A2 | 9/1995 | European Pat. Off. | E21B 47/12 |

*Primary Examiner*—Michael Horabik
*Assistant Examiner*—Albert K. Wong
*Attorney, Agent, or Firm*—Paul I. Herman; Lawrence R. Youst

[57] ABSTRACT

An apparatus, method and system for communicating information between downhole equipment (40) and surface equipment is disclosed. The electromagnetic signal repeater apparatus (34, 36) comprises a housing (102) that is securably mountable to the exterior of a pipe string (30) disposed in a wellbore (32). The housing (102) includes first and second housing subassemblies (104, 106). The first housing subassembly (104) is electrically isolated from the second housing subassembly (106) by a gap subassembly (108) having a length that is at least two times the diameter of the housing (102). The first housing subassembly (104) is electrically isolated from the pipe string (30) and is secured thereto with a nonconductive strap (120). The second housing subassembly (106) is electrically coupled with the pipe string (30) and is secured thereto with a conductive strap (122). An electronics package (127) and a battery (126) are disposed within the housing (102). The electronics package (127) receives, processes and retransmits the information being communicated between the downhole equipment (40) and the surface equipment via electromagnetic waves (46, 48, 50).

13 Claims, 4 Drawing Sheets

U.S. PATENT DOCUMENTS

| | | | |
|---|---|---|---|
| 4,933,640 | 6/1990 | Kuckes | 324/339 |
| 4,968,978 | 11/1990 | Stolarczyk | 340/854 |
| 5,087,099 | 2/1992 | Stolarczyk | 299/1 |
| 5,130,706 | 7/1992 | Van Steenwyk | 340/854.6 |
| 5,160,925 | 11/1992 | Dailey et al. | 340/853.3 |
| 5,268,683 | 12/1993 | Stolarczyk | 340/854.4 |
| 5,396,232 | 3/1995 | Mathieu et al. | 340/854.5 |
| 5,448,227 | 9/1995 | Orban et al. | 340/854.4 |
| 5,467,083 | 11/1995 | McDonald et al. | 340/854.6 |
| 5,467,832 | 11/1995 | Orban et al. | 175/45 |
| 5,493,288 | 2/1996 | Henneuse | 340/854.4 |
| 5,530,358 | 6/1996 | Wisler et al. | 324/338 |
| 5,576,703 | 11/1996 | MacLeod et al. | 340/854.4 |

DISPOSABLE ELECTROMAGNETIC SIGNAL REPEATER

This application is a division of pending application Ser. No. 08/999,088 filed on Dec. 29, 1997 now pending.

TECHNICAL FIELD OF THE INVENTION

The present invention relates, in general, to downhole telemetry and, in particular to, the use of electromagnetic repeaters for communicating information between downhole locations and surface equipment.

BACKGROUND OF THE INVENTION

Without limiting the scope of the present invention, its background will be described with reference to transmitting downhole data to the surface during completion and production, as an example. The principles of the present invention, however, are applicable throughout the utilization of the well including, but not limited to, drilling, logging and testing the well.

In the past, a variety of communication and transmission techniques have been attempted in order to provide real time data from downhole locations to the surface during the completion and the production process. The ability to obtain real time data transmission provides substantial benefits during operations that enable increased control of these processes. Continuous monitoring of downhole conditions allows for a timely response to possible well control problems and improves operational response to problems or potential problems allowing for the optimization of production parameters. For example, monitoring of downhole conditions allows for an immediate response to the production of water or sand.

Multiple types of telemetry systems have been utilized in attempts to provide real time downhole data transmission. For example, systems have utilized pressure pulses, insulated conductors and acoustic waves to telemeter information. Additionally, electromagnetic waves have been used to transmit data between downhole locations and the surface. Electromagnetic waves are produced by inducing an axial current into, for example, the production casing. The electromagnetic waves include an electric field and a magnetic field, formed at right angles to each other. The axial current impressed on the casing is modulated with data causing the electric and magnetic fields to expand and collapse thereby allowing the data to propagate and be intercepted by a receiving system. The receiving system is typically connected to the ground or sea floor where the electromagnetic data is picked up and recorded.

As with any communication system, the intensity of the electromagnetic waves is directly related to the distance of transmission. Consequently, the greater the distance of transmission, the greater the loss of power and hence the weaker the received signal. Typically, downhole electromagnetic telemetry systems must transmit the electromagnetic waves through the earth's strata. In free air, the loss is fairly constant and predictable. When transmitting through the earth's strata, however, the amount of signal received is dependent upon the skin depth ($\delta$) of the media through which the electromagnetic waves travel. Skin depth is defined as the distance at which the power from a downhole signal will attenuate by a factor of 8.69 db (approximately seven times decrease from the initial power input), and is primarily dependent upon the frequency (f) of the transmission and the conductivity ($\sigma$) of the media through which the electromagnetic waves are propagating. For example, at a frequency of 10 Hz, and a conductance of 1 mho/meter (1 ohm-meter), the skin depth would be 159 meters (522 feet). Therefore, for each 522 feet in a consistent 1 mho/meter media, an 8.69 db loss occurs. Skin depth may be calculated using the following equation.

$$\text{Skin Depth}=\delta=1/(\pi f\mu\sigma) \text{ where:}$$

$\pi$=3.1417;

f=frequency (Hz);

$\mu$=permeability ($4\pi\times10^{6}$); and $\sigma$=conductance (mhos/meter).

As should be apparent, the higher the conductance of the transmission media, the lower the frequency must be to achieve the same transmission distance. Likewise, the lower the frequency, the greater the distance of transmission with the same amount of power.

A typical electromagnetic telemetry system that transmits electromagnetic waves through the earth's strata may successfully propagate through ten (10) skin depths. In the example above, for a skin depth of 522 feet, the total transmission and successful reception depth would be approximately 5,220 feet. Since many, if not most wells are substantially deeper, systems utilizing electromagnetic waves as a means of transmitting real time downhole data typically involve the use of repeaters to receive, clean up and retransmit to the surface or to the next repeater.

Proposed downhole electromagnetic repeaters have been large, expensive, cumbersome devices that typically form a joint in the pipe string. The cost of such devices typically necessitated that the device be retrieved after use. Further, the installation or removal of such devices is time consuming and expensive due to the need for a rig to trip the pipe string into or out of the wellbore.

Therefore, a need has arisen for an economical system that is capable of real time telemetry of data between downhole equipment and surface equipment in a deep or noisy well using electromagnetic waves to carry the information. A need has also arisen for such a system that is easily installed and that uses inexpensive electromagnetic repeaters for the relaying of electromagnetic transmissions which may remain in the wellbore following use.

SUMMARY OF THE INVENTION

The present invention disclosed herein includes an apparatus, system and method for communicating real time information between surface equipment and downhole equipment using electromagnetic waves to carry the information. The electromagnetic signal repeater described herein is economical, simple in operation, easily installed and adaptable with other electromagnetic repeaters in order to provide an inexpensive and disposable system. Due to the low cost of the apparatus, there is no economic need to retrieve the device for reuse. As such, the repeater of the present invention serves to reduce expensive rig time and provides convenient, economical telemetry of information between downhole locations and the surface.

The electromagnetic signal repeater of the present invention comprises a housing that is securably mountable to the exterior of a pipe string that is disposed in a wellbore. The housing includes first and second housing subassemblies. The first housing subassembly is electrically isolated from the second housing subassembly by a gap subassembly that has a length that is at least two times the diameter of the housing. The first housing subassembly is electrically isolated from the pipe string and is secured to the pipe string with a nonconductive strap. The second housing subassembly is electrically coupled with the pipe string and is secured to the pipe string with a conductive strap. The repeater of the present invention may, therefore, receive electromagnetic input signals carrying information. The repeater of the present invention may also impress an axial current in the pipe string to generate an electromagnetic output signal carrying the information.

An electronics package and a battery pack are disposed within the housing. The electronics package receives, processes and retransmits the information. The electronics package may include a limiter, a preamplifier, a notch filter, a bandpass filter, a frequency to voltage converter, a voltage to frequency converter and a power amplifier. Alternatively, the electronics package may include a limiter, a preamplifier, a notch filter, a bandpass filter, a phase lock loop, a series of shift register and a power amplifier.

In the system of the present invention, the electromagnetic signal repeater is communicably coupled to a downhole device for receiving and transmitting electromagnetic signals and a surface device for receiving and transmitting electromagnetic signals. In such a configuration, the system of the present invention provides for communication from the surface downhole, from downhole to the surface and for two way communications between surface equipment and downhole equipment.

The method of the present invention comprises securably mounting an electromagnetic signal repeater, including a housing having first and second housing subassemblies, to the exterior of a pipe string that is disposed in a wellbore. The method includes electrically isolating the first housing subassembly from the second housing subassembly and the pipe string and electrically coupling the second housing subassembly with the pipe string. The first and second housing subassemblies may be electrical isolation by disposing a gap subassembly therebetween. The first housing subassembly may be secured to the pipe string with a nonconductive strap while the second housing assembly may be secured to the pipe string with a conductive strap.

The method of the present invention also includes receiving an electromagnetic input signal carrying information, processing the information in an electronics package disposed within the housing and retransmitting the information by generating an electromagnetic output signal. The electronics package is powered by a battery disposed within the housing. Processing the information within the electronics package may include filtering the information, storing the information and amplifying the information. Generating the electromagnetic output signal may include impressing an axial current in the pipe string.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides numerous applicable inventive concepts which can be embodied in a wide variety of specific contexts. The specific embodiments discussed herein are merely illustrative of specific ways to make and use the invention, and do not limit the scope of the invention.

Figure 1:
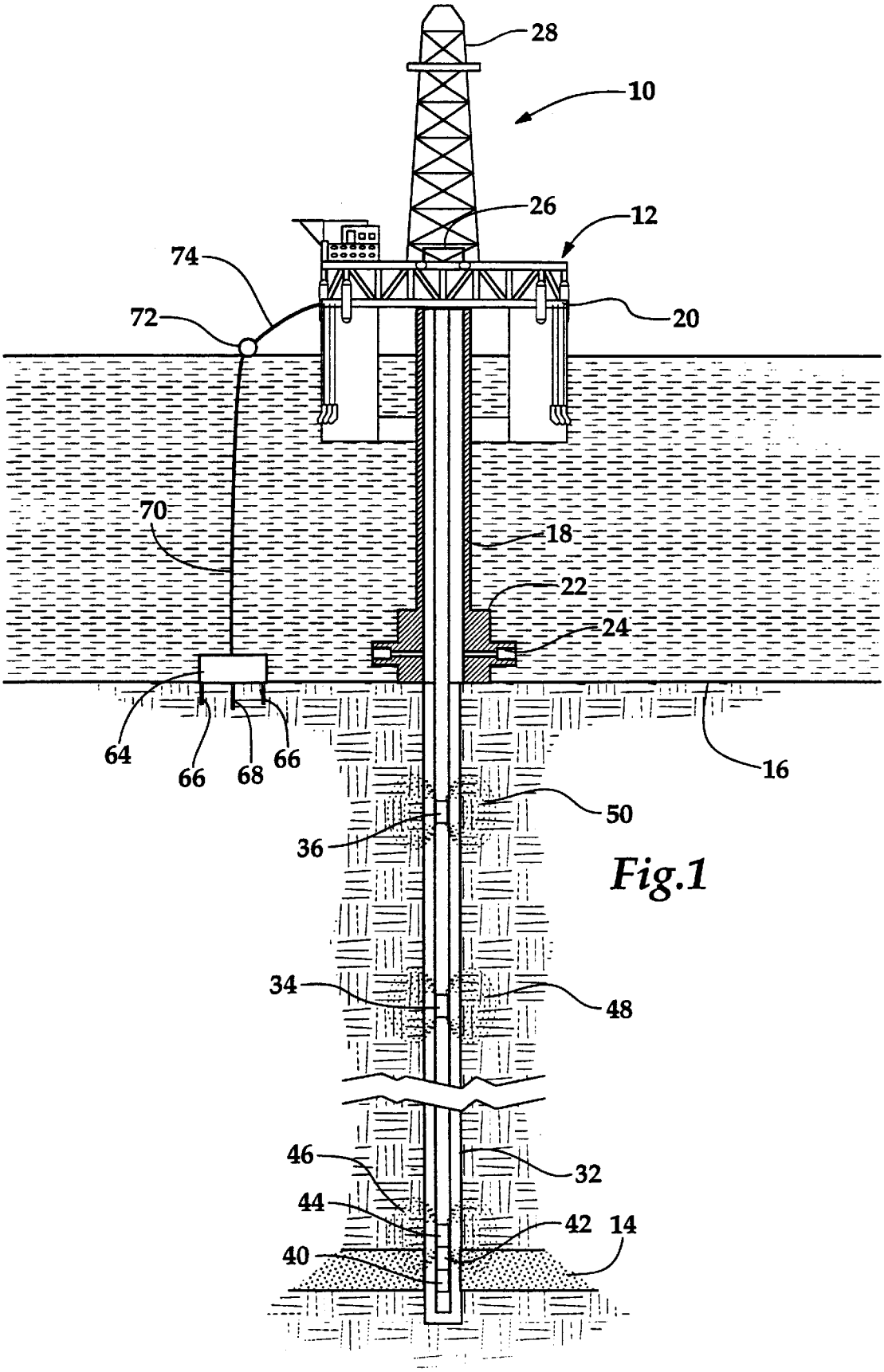
FIG. 1 is a schematic illustration of a telemetry system utilizing an electromagnetic signal repeater of the present invention.

Referring now to FIG. 1, a communication system including an electromagnetic signal generator and a plurality of electromagnetic signal repeaters for use with an offshore oil and gas drilling platform is schematically illustrated and generally designated 10. A semi-submergible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for manipulating tubing string 30, positioned inside wellbore 32 during completion operations. Wellbore 32 may be cased or uncased, depending upon the particular application, the depth of the well, and the strata through which the wellbore extends. In some applications, wellbore 32 will be partially cased, i.e., the casing will extend only partially down the length of wellbore 32.

Attached to the tubing string 30 are electromagnetic signal repeaters 34, 36 for providing communication between one or more sensors 40 and the surface. During the completion phase, various tasks are performed such as well perforation, formation testing, packer setting and the placement of various tools and downhole equipment. The placement and operation of these devices may be monitored by one or more sensors 40 located at selected locations along tubing string 30. Parameters such as pressure and temperature as well as a variety of other environmental and formation information may be obtained by sensors 40. The signal generated by sensors 40 may typically be an analog signal, which is normally converted to a digital data format before electromagnetic transmission utilizing 1's and 0's for information transmission.

The signal is sent to electronics package 42 that may include electronic devices such as an on/off control, a modulator, a microprocessor, memory and amplifiers. Electronics package 42 is typically powered by a battery pack which may include a plurality of batteries, such as nickel cadmium or lithium batteries, which are configured to provide proper operating voltage and current.

Once the frequency, power and phase output is established, the signal carrying the information is forwarded to electromagnetic transmitter 44 that generates electromagnetic wave fronts 46 which propagate through the earth. Transmitter 44 may be a direct connect to tubing string 30 or may electrically approximate a transformer.

As illustrated, in FIG. 1 the electromagnetic wave fronts 46 are picked up by a receiver of repeater 34 located uphole from transmitter 44. Repeater 34 is spaced along drill string 30 to receive the electromagnetic wave fronts 46 while electromagnetic wave fronts 46 remain strong enough to be readily detected. As electromagnetic wave fronts 46 reach repeater 34, a current is induced in the receiver that carries the information originally obtained by sensors 40.

Repeater 34 includes an electronic package that processes the electrical signal that is produced by the receiver as will be more fully described with reference to FIGS. 6 and 7. After processing, the electrical signal is passed to a transmitter that generates electromagnetic wave fronts 48. Repeater 36 may operate in the manner described above with reference to repeater 34 by receiving electromagnetic wave fronts 48, processing the induced current in an electronics package and generating electromagnetic wave fronts 50 that are received by electromagnetic pick up device 64 on sea floor 16. Electromagnetic pickup device 64 may sense either the electric field or the magnetic field of electromagnetic wave front 50 using an electric field sensor 66 or a magnetic field sensor 68 or both.

The electromagnetic pickup device 64 serves as a transducer transforming electromagnetic wave front 50 into an electrical signal using a plurality of electronic devices. The electrical signal may be sent to the surface via electric wire 70 that is attached to buoy 72 and onto platform 12 for further processing via electric wire 74. Upon reaching platform 12, the information originally obtained by sensors 40 is further processed making any necessary calculations and error corrections such that the information may be displayed in a usable format.

Even though FIG. 1 depicts two repeaters 34, 36 it should be noted by one skilled in the art that the number of repeaters located along drill string 30 will be determined by the depth of wellbore 32, the noise level in wellbore 32 and the characteristics of the earth's strata adjacent to wellbore 32. As should be appreciated by those skilled in the art, electromagnetic waves are subject to diminishing attenuation with increasing distance from the wave source at a rate that is dependent upon, among other factors, the composition characteristics of the transmission medium and the frequency of transmission. Consequently, electromagnetic signal repeaters, such as electromagnetic signal repeaters 34, 36 may be positioned between 2,000 and 5,000 feet apart along the length of wellbore 32. Thus, if wellbore 32 is 15,000 feet deep, between two and six electromagnetic signal repeaters such as electromagnetic signal repeaters 34, 36 may be desirable.

Additionally, while FIG. 1 has been described with reference to transmitting information uphole during a completion operation, it should be understood by one skilled in the art that repeaters 34, 36 may be used during all phases of the life of wellbore 32 including, but not limited to, drilling, logging, testing and production. Also, it should be noted that repeaters 34, 36 may be mounted, not only on tubing string 30, but also on drill pipe, casing, coiled tubing and the like.

Further, even though FIG. 1 has been described with reference to one way communication from the vicinity of sensors 40 to platform 12, it will be understood by one skilled in the art that the principles of the present invention are applicable to communication from the surface to a downhole location or two-way communication. For example, a surface installation may be used to request downhole pressure, temperature, or flow rate information from formation 14 by transmitting electromagnetic signals downhole which would again be received, processed and retransmitted as described above with reference to repeaters 34, 36. Sensors, such as sensors 40, located near formation 14 receive the request and obtain the appropriate information which would then be returned to the surface via electromagnetic wave fronts 46 which would again be amplified and transmitted electromagnetically as described above with reference to repeater 34, 36. As such, the phrase "between surface equipment and downhole equipment" as used herein encompasses the transmission of information from surface equipment downhole, from downhole equipment uphole, or for two-way communications.

Whether the information is being sent from the surface to a downhole destination or a downhole location to the surface, electromagnetic wave fronts such as electromagnetic wave fronts 46, 48, 50, may be radiated at varying frequencies such that the appropriate receiving device or devices detect that the signal is intended for the particular device. Additionally, repeaters 34, 36 may include blocking switches which prevent the receivers from receiving signals while the associated transmitters are transmitting.

Figure 2:
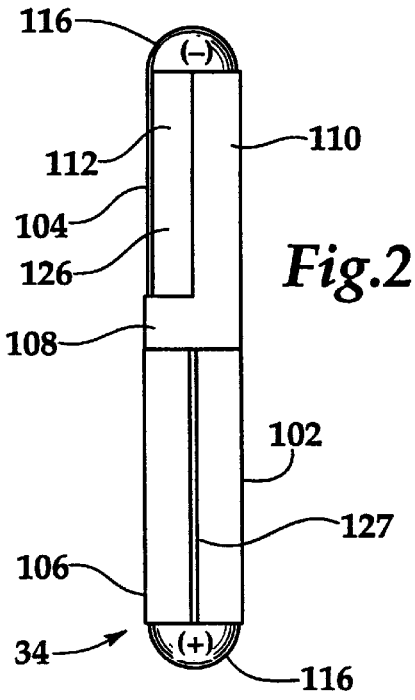
FIG. 2 is an isometric illustration of an electromagnetic signal repeater apparatus of the present invention.
Figure 3:
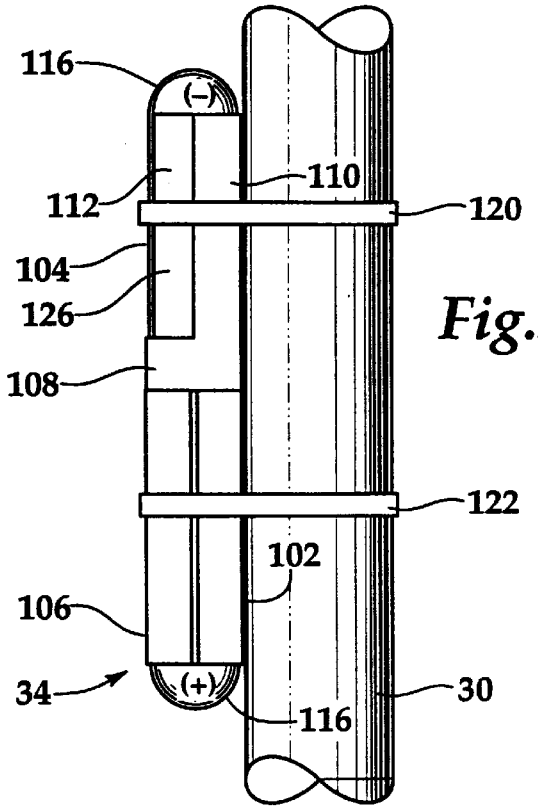
FIG. 3 is an isometric illustration of an electromagnetic signal repeater apparatus of the present invention attached to a pipe string.

In FIG. 2, electromagnetic repeater 34 of the present invention is illustrated. Repeater 34 is contained within a tubular two-piece pressure housing assembly 102. The pressure housing 102 includes an upper pressure housing subassembly 104 having a ground potential and a lower pressure housing subassembly 106 with a positive electrical potential. An insulated gap area 108, of predetermined length is provided between the upper and lower pressure housing subassemblies 104, 106 to provide electrical isolation therebetween. As illustrated in FIG. 3, repeater 34 may be strapped or fastened to the exterior of tubing string 30. Although pressure housing assembly 102 of repeater 34 has been illustrated as an axially extending tubular enclosure, other geometries for pressure housing 102 may be possible and are considered to fall within the scope of the invention.

It should be apparent to those skilled in the art that the use of directional terms such as above, below, upper, lower, upward, downward, etc. are used in relation to the illustrative embodiments as they are depicted in the Figures, the upward direction being toward the top of the corresponding Figure and the downward direction being toward the bottom of the corresponding Figure. It is to be understood that repeater 34 may be operated in vertical, horizontal, inverted or inclined orientations without deviating from the principles of the present invention.

The upper and lower housing subassemblies 104 and 106 may be fabricated from an electrically conductive material such as a standard electrically conductive steel. Upper pressure housing subassembly 104 is provided with an insulating layer 110 on the side of repeater 34 that would normally make contact with tubing string 30 as depicted in FIG. 3. The insulating layer 110 electrically isolates the upper housing subassembly 104 of repeater 34 to prevent a direct electrical short circuit from occurring between repeater 34 and tubing string 30 that would inhibit the propagation of electromagnetic wave fronts 48 launched by repeater 34. Insulating layer 110 may be an impact-resistant material such as reinforced glass-impregnated cross-linked polymers, e.g., fiberglass, or similar material. A portion 112 of the upper housing subassembly 104 is not insulated and is placed on the side opposite the tubing string 30, thereby providing a clear circuit for the launching of electromagnetic wave fronts 48 from repeater 34.

The upper pressure housing subassembly 104 is separated from the lower housing subassembly 106 by an electrically isolated area or gap 108. It has been found that the longitudinal length of the gap 108 is an important consideration in the design of the repeater 34. Preferably, the gap 108 is between two (2) and five (5) times the diameter of the pressure housing assembly 102 to insure proper launching and transmission of electromagnetic wave fronts 48.

As best illustrated in FIG. 2, the battery or battery pack 126 is contained in the upper housing subassembly 104 with the electronics package 127 contained within the lower housing subassembly 106. A negative electrical connection is made to the upper housing subassembly 104, with modulated electromagnetic output being connected to the lower housing subassembly 106. The lower housing subassembly 106 makes direct electrical contact with tubing string 30. The upper housing subassembly 104 is fastened to tubing string 30 with a non-conductive fastener 120 such as a fiberglass strap, while the lower housing subassembly 106 is clamped to tubing string 30 with a conductive strap 122. Alternatively, the upper pressure housing subassembly 104 may be connected to tubing string 30 with a metallic strap, in which case, insulation is provided between the strap and tubing string 30 to electrically isolate the upper housing subassembly 104 from tubing string 30.

When repeater 34 receives a transmission and is instructed to retransmit the signal, a current is generated which, because the lower pressure housing subassembly 106 is in electrical contact with the pipe, is impressed on the tubing string 30. This, in turn, generates an axial current in the tubing string 30 to produce electromagnetic waves, such as electromagnetic wave fronts 48 of FIG. 1 to carry the modulated signal to repeater 36.

Figure 4:
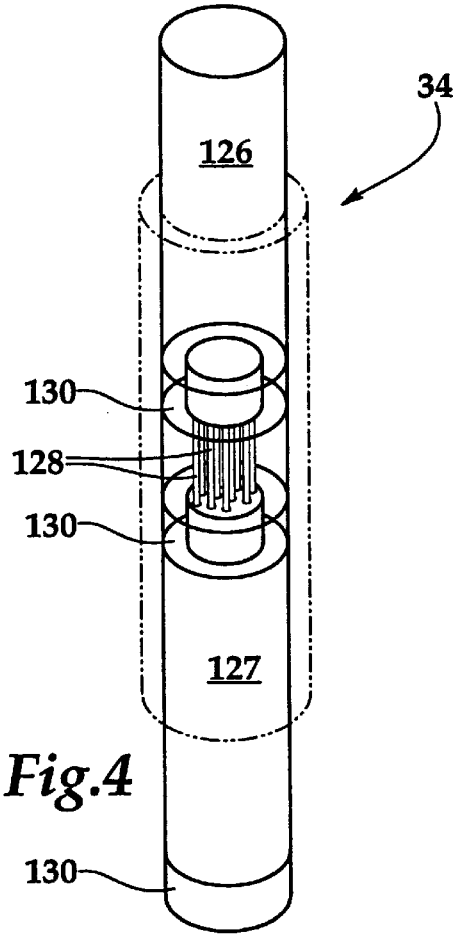
FIG. 4 is an exploded view of an electromagnetic signal repeater apparatus of the present invention.

Referring now to FIG. 4, the battery 126 disposed within upper housing subassembly 104 and electronics package 127 disposed within lower housing subassembly 106 are connected by one or more connectors 128 in a modular design that enables rapid and convenient exchange of the battery 126 or electronics package 127. Additionally, the battery 126 and electronics package 127 are protected by shock plugs 130 to reduce the probability of damage from shock and vibrations in a downhole environment when the unit is installed or during production operations.

Figure 5A:
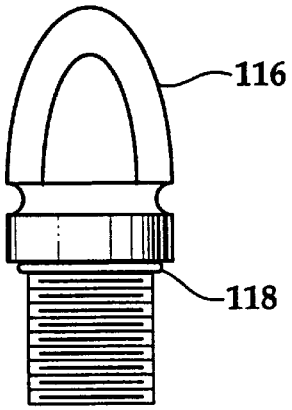
FIGS. 5A–5B are a perspective views of end plugs utilized in connection with an electromagnetic signal repeater apparatus of the present invention.
Figure 5B:
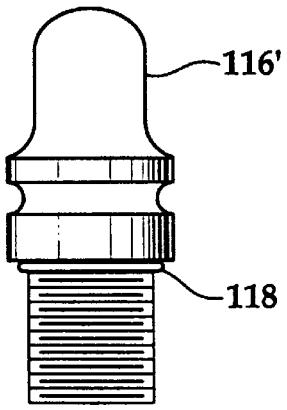

Referring next to FIGS. 5A–5B, the upper housing subassembly 104 and lower housing subassembly 106 of the repeater 34 of the present invention are each terminated with end plugs such as bull nose plugs 116 or 116' which may be threadably engaged with the upper and lower housing subassemblies 104, 106. The bull nose plugs 116, 116' include a seal, such as an O-ring 118 to seal against downhole pressure. The use of bull nose plugs 116, 116' also provides easy access to the internal components of repeater 34.

Figure 6:
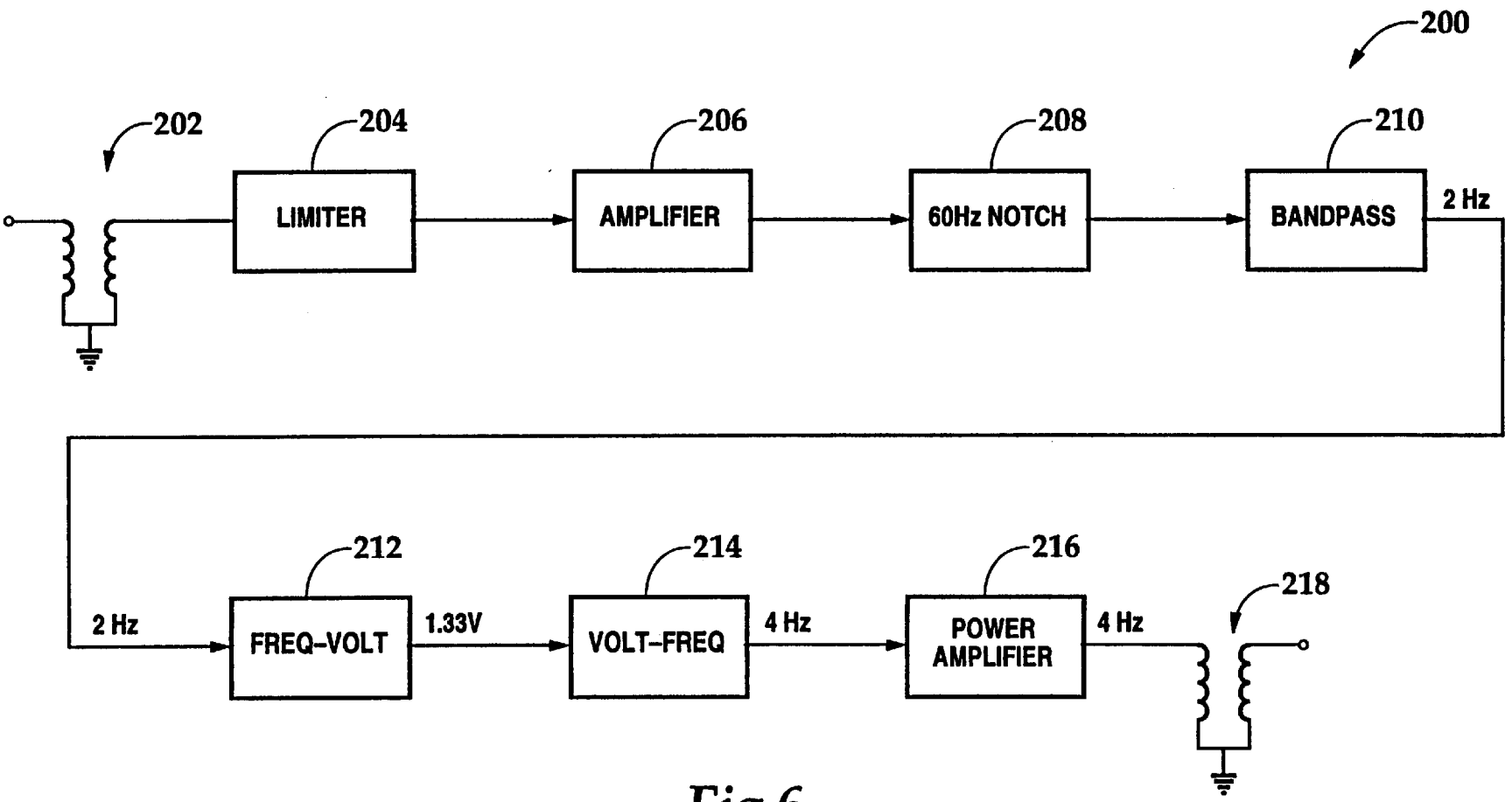
FIG. 6 is a block diagram illustrating a method for processing information by an electronics package of an electromagnetic signal repeater apparatus of the invention.

Referring now to FIG. 6 and with reference to FIG. 1, the pass through processing method of the present invention is depicted in a block diagram generally designated 200. Electromagnetic wave fronts 46 from transmitter 44 are received by receiver 202. The induced current representing the signal is fed to a limiter 204. Limiter 204 may include a pair of diodes for attenuating the noise in the signal to a predetermined range, such as between about 0.3 and 0.8 volts. The signal is then passed to amplifier 206 which may amplify the signal to a predetermined voltage, acceptable for circuit logic, such as 5 volts. The signal is then passed through a notch filter 208 to shunt noise at a predetermined frequency, such as 60 hertz which is a typical frequency for electrical noise in the United States whereas a European application may have a 50 hertz notch filter. The signal then enters a bandpass filter 210 to eliminate noise above and below the desired frequency and to recreate the original waveform having the original frequency, for example, two hertz.

The clarified signal from bandpass filter 210 is then passed to a frequency-to-voltage converter 212 and subsequently to a voltage-to-frequency converter 214 for modulation. The signal strength is then increased in power amplifier 216 and passed on to electromagnetic transmitter 218. Thus, electronics package 200 cleans up and amplifies the signal to reconstruct the original waveform, compensating for losses and distortion occurring during the transmission of electromagnetic wave fronts 46 through the earth. Transmitter 218 transforms the electrical signal into an electromagnetic signal such as electromagnetic wave fronts 48, which are radiated into the earth to be detected by repeater 36.

Figure 7:
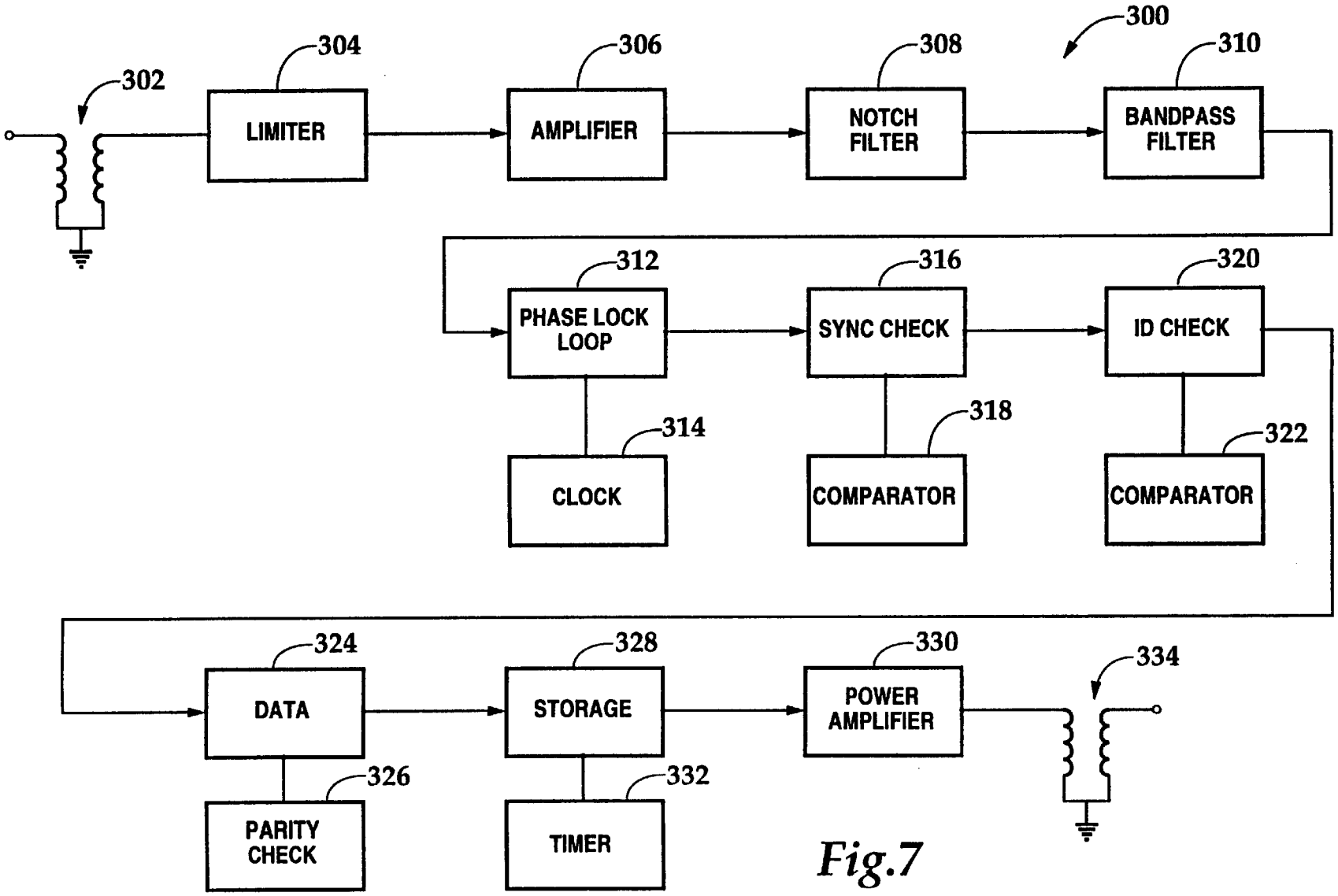
FIG. 7 is a block diagram illustrating another method for processing information by an electronics package of an electromagnetic signal repeater apparatus of the invention.

Referring now to FIG. 7 and with reference to FIG. 1, a digital method to process the information within repeater 34 of the present invention is illustrated and generally designated 300. Electromagnetic wave fronts 46 from transmitter 44 are detected by receiver 302. The induced current representing the signal is fed to a limiter 304. Limiter 304 may include a pair of diodes for attenuating the noise in the signal to a predetermined range, such as between about 0.3 and 0.8 volts. The signal is then passed to amplifier 306 which may amplify the signal to a predetermined voltage, acceptable for circuit logic, such as 5 volts. The signal is then passed through a notch filter 308 to shunt noise at a predetermined frequency, such as 60 hertz which is a typical frequency for electrical noise in the United States whereas a European application may have a 50 hertz notch filter. The signal then enters a bandpass filter 310 to eliminate noise above and below the desired frequency and to recreate the original waveform having the original frequency, for example, two hertz.

The signal is then fed through a phase lock loop 312 that is controlled by a precision clock 314 to assure that the signal passing through bandpass filter 310 has the proper frequency and is not simply noise. As the signal will include a certain amount of carrier frequency first, phase lock loop 312 is able to verify that the received signal is, in fact, a legitimate signal and not merely extraneous noise. The signal then enters a series of shift registers that perform a variety of error checking features.

Sync check 316 reads, for example, the first six bits of the information carried in the signal. These first six bits are compared with six bits that are stored in comparator 318 to determine whether the signal is carrying the type of information intended for a repeater such as repeater 34. For example, the first six bits in the preamble to the information carried in electromagnetic wave fronts 46 must carry the code stored in comparator 318 in order for the signal to pass through sync check 316. Each of the repeaters of the present invention, such as repeaters 34, 36, will require the same code in comparator 318.

If the first six bits in the preamble correspond with that in comparator 318, the electrical signal passes to a repeater identification check 320. Identification check 320 determines whether the information received by a specific repeater is intended for that repeater. The comparator 322 of repeater 34 will require a specific binary code while comparator 322 of repeater 36 will require a different binary code.

After passing through identification check 320, the signal is shifted into a data register 324 which is in communication with a parity check 326 to analyze the information carried in the signal for errors and to assure that noise has not infiltrated and abrogated the data stream by checking the parity of the data stream. If no errors are detected, the signal is shifted into one or more storage registers 328. Storage registers 328 receive the entire sequence of information and either passes the electrical signal directly into power amplifier 330 or stores the information for a specified period of time determined by timer 332. In either case, after the signal is passed through power amplifier 330, transmitter 334 transforms the signal into an electromagnetic signal, such as electromagnetic wave fronts 48, which is radiated into the earth to be picked up by repeater 36 of FIG. 1.

Even though FIG. 7 has described sync check 316, identification check 320, data register 324 and storage register 328 as shift registers, it should be apparent to those skilled in the art that alternate electronic devices may be used for error checking and storage including, but not limited to, random access memory, read only memory, erasable programmable read only memory and a microprocessor.

The repeaters of the present invention provide numerous advantages over prior art systems. Simplicity of design allows units to be produced at low cost whereby the repeater may be left in wellbore 32 following, for example, a completion operation. The low cost of the repeater saves rig time which would otherwise be expended retrieving expensive items from wellbore 32 following completion operations. The repeater is easy to install by simply strapping the repeater to the completion piping prior to tripping the completion piping into the well. No special equipment or joints are required on the completion piping to utilize the repeater of the present invention. Also, as described above, the modular design of repeater 34 allows for changing the configuration of repeater 34 from a pass through to a digital mode while on the rig floor with a minimum amount of time spent.

While the invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A system for communicating information between downhole equipment in a wellbore and surface equipment comprising:

a pipe string extending downhole into the wellbore;

a downhole device for receiving and transmitting electromagnetic signals;

a surface device for receiving and transmitting electromagnetic signals; and an electromagnetic signal repeater including a housing securably mountable exteriorly of the pipe string and an electronics package electrically coupled to the housing for processing the information received in an electromagnetic input signal received by the housing and generating an output signal carrying the information to be electromagnetically retransmitted by the housing, the housing including first and second housing subassemblies, the first housing subassembly electrically isolated from the second housing assembly and the pipe string, the second housing subassembly electrically coupled with the pipe string.

2. The system of claim 1 wherein an axial electric current is impressed within the pipe string by the electromagnetic signal repeater to generate an electromagnetic output signal for the retransmission the information.

3. The system of claim 1 further comprising a battery disposed in the second housing subassembly.

4. The system of claim 1 wherein the first housing subassembly is secured to the pipe string with a nonconductive strap and the second housing assembly is secured to the pipe string with a conductive strap.

5. The system of claim 1 further wherein the electromagnetic signal repeater further comprises a gap subassembly disposed between the first and second housing subassemblies to provide electrical isolation therebetween.

6. The system of claim 5 wherein the gap subassembly has a length of at least two times the diameter of the housing.

7. The system of claim 1 wherein the electronics package further comprises a limiter.

8. The system of claim 1 wherein the electronics package further comprises a notch filter.

9. The system of claim 1 wherein the electronics package further comprises a bandpass filter.

10. The system of claim 1 wherein the electronics package further comprises a frequency to voltage converter and a voltage to frequency converter.

11. The system of claim 1 wherein the electronics package further comprises a phase lock loop.

12. The system of claim 1 wherein the electronics package further comprises at least one shift register.

13. The system of claim 1 wherein the electronics package further comprises an amplifier.

* * * * *